US007156703B1

(12) United States Patent
Hurley, III et al.

(10) Patent No.: US 7,156,703 B1
(45) Date of Patent: Jan. 2, 2007

(54) ELECTRICAL CONDUCTOR TAP

(76) Inventors: James P. Hurley, III, 1227 Clifton Ave., Akron, OH (US) 44310; Patrick M. Hinman, 1194 Berwin St., Akron, OH (US) 44310; William J. Sparenga, 1174 Mac Dr., Stow, OH (US) 44224

( * ) Notice: Subject to any disclaimer, the term of this patent is extended or adjusted under 35 U.S.C. 154(b) by 0 days.

(21) Appl. No.: 11/240,063

(22) Filed: Oct. 3, 2005

(51) Int. Cl.
*H01R 4/36* (2006.01)

(52) U.S. Cl. ..... 439/814

(58) Field of Classification Search ..... 439/814, 439/813, 812, 811, 810
See application file for complete search history.

(56) References Cited

U.S. PATENT DOCUMENTS

| | | | | | |
|---|---|---|---|---|---|
| 1,853,173 | A | * | 4/1932 | Okun | 337/197 |
| 1,943,660 | A | * | 1/1934 | Edwards | 439/798 |
| 3,047,835 | A | * | 7/1962 | Kelly | 439/798 |
| 3,283,290 | A | * | 11/1966 | Carlson | 439/812 |
| 3,408,620 | A | * | 10/1968 | Damiano | 439/797 |
| 3,546,364 | A | * | 12/1970 | O'Neel | 174/72 R |
| 3,829,825 | A | * | 8/1974 | Hawkins | 439/798 |
| 3,864,013 | A | * | 2/1975 | Levy | 439/724 |
| 3,962,091 | A | * | 6/1976 | Doria et al. | 210/232 |
| 4,223,179 | A | * | 9/1980 | Lusk et al. | 174/73.1 |
| 4,466,686 | A | * | 8/1984 | Houser | 439/568 |
| 4,549,755 | A | | 10/1985 | Kot et al. | |
| 4,808,124 | A | * | 2/1989 | Spinner et al. | 439/578 |
| 4,831,213 | A | | 5/1989 | Espevik et al. | |
| 4,925,395 | A | * | 5/1990 | Franks, Jr. | 439/100 |
| 5,000,705 | A | * | 3/1991 | Kinka et al. | 439/797 |
| 5,137,476 | A | * | 8/1992 | Noble | 439/797 |
| 5,789,706 | A | | 8/1998 | Perkins | |
| 6,452,103 | B1 | | 9/2002 | Piriz et al. | |
| 6,568,952 | B1 | | 5/2003 | Tomasino | |
| 6,747,211 | B1 | | 6/2004 | Connor et al. | |
| 6,748,968 | B1 | | 6/2004 | Parsons et al. | |
| 6,796,855 | B1 | | 9/2004 | Fricke et al. | |
| 6,835,104 | B1 | | 12/2004 | West et al. | |

* cited by examiner

*Primary Examiner*—Tulsidas C. Patel
*Assistant Examiner*—Phuongchi Nguyen
(74) *Attorney, Agent, or Firm*—John D. Gugliotta

(57) ABSTRACT

An electrical tap connector is provided having a housing that forms a first attachment section aligned with a second attachment section. Each attachment section forms a conductor receiving orifice into a conductor receiving channel. The housing about each section forms a pair of opposed and offset screw receiving orifices which are threadingly engaged with a set screw. The each pair of opposed and offset set screws mechanically bind an electrical conduct in a tortuous, crimped pattern within the receiving channel.

6 Claims, 1 Drawing Sheet

ELECTRICAL CONDUCTOR TAP

RELATED APPLICATIONS

The present invention contains subject matter that was first described in Disclosure Document Registration 583,712 filed on Aug. 11, 2005 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to electrical connectors and, more particularly, to an electrical conductor compression device for securely maintaining highly conductive contact with a live conductor during tapping.

2. Description of the Related Art

As is well known in the art, electrical conductors are commonly connected through various types of mechanisms. One such type, known as a "tap" is commonly used to make electrical connection between two separate conductors. Such devices, however, generally utilize a compression device that provide mechanical impingement between the ends of connected conductors to provide both mechanical and electrical contact there between. However, with thermal cycling of the conductor due to current cycling or weather changes, such compression devices are know to disengage, overcoming the compression force, and thereby causing a broken circuit or arcing hazard.

A search of the prior art did not disclose any patents that read directly on the claims of the instant invention; however, the following references were considered related.

The following two patents disclose electrical compression connectors: U.S. Pat. No. 6,452,103 B1, issued in the name of Piriz et al.; and U.S. Pat. No. 6,747,211 B2, issued in the name of Connor et al.

U.S. Pat. No. 6,568,952 B1, issued in the name of Tomasino discloses a T-tap connector for making connection of a main electrical conductor without stripping the insulation or without splicing.

U.S. Pat. No. 6,748,968 B1, issued in the name of Parsons et al. discloses a method and apparatus for combined conduit/electrical-conductor junction installation which provides fluid, electrical-power and control-signal connections.

U.S. Pat. No. 6,796,855 B2, issued in the name of Fricke et al. discloses an electrical connector for connecting a conductor to a bus bar.

U.S. Pat. No. 6,835,104 B2, issued in the name of West et al. discloses a field configurable base for a busway tap-off unit adapted for use with a busway electrical distribution system having a plurality of electrical phase conductors and at least one additional electrical conductor for a preselected function.

U.S. Pat. No. 4,549,755, issued in the name of Kot et al. discloses a watertight connector for jacketed metal clad armored cable.

U.S. Pat. No. 4,831,213, issued in the name of Espevik et al. discloses a waterproof swivel fitting for an electrical conduit and the like.

U.S. Pat. No. 5,789,706, issued in the name of Perkins discloses an electrical cable to utilization device quick connector that quickly and securely connects an electrical cable to a utilization device from the exterior of the utilization device without having to access the interior of the utilization device to turn a locking nut.

Consequently, a need has been felt for providing an apparatus and method of providing for taping of electrical conductors, whether or not under electrical potential, in a manner that is more secure against disengagement.

SUMMARY OF THE INVENTION

It is therefore an object of the present invention to provide an improved electrical connectors.

It is a feature of the present invention to provide an electrical conductor compression device for securely maintaining highly conductive contact with a live conductor during tapping.

Briefly described according to one embodiment of the present invention, an electrical tap connector is provided having a housing that forms a first attachment section aligned with a second attachment section. Each attachment section forms a conductor receiving orifice into a conductor receiving channel. The housing about each section forms a pair of opposed and offset screw receiving orifices which are threadingly engaged with a set screw. The each pair of opposed and offset set screws mechanically bind an electrical conduct in a tortuous, crimped pattern within the receiving channel.

In accordance with the present invention, by threadingly engaging the set screws, the conductors are tapped together in a manner that prevents disengagement, even with the accidental or naturally gradual removal of one or more set screws.

Further, a preferred embodiment of the present invention can be used with any of the various sized conductors by utilizing various sized housings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
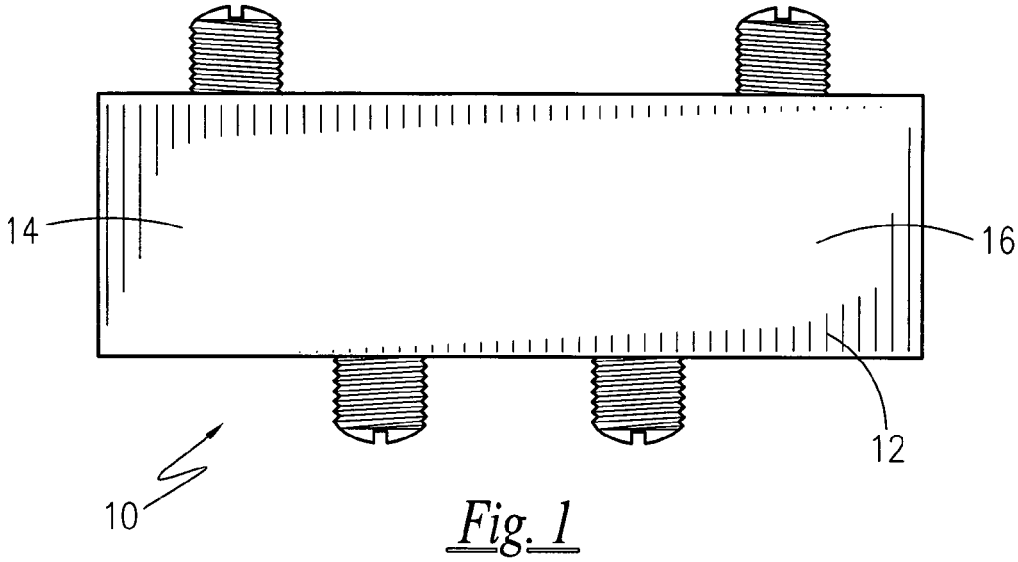
FIG. 1 is a front plan view of an electrical conductor tap according to the preferred embodiment of the present invention.
Figure 2:
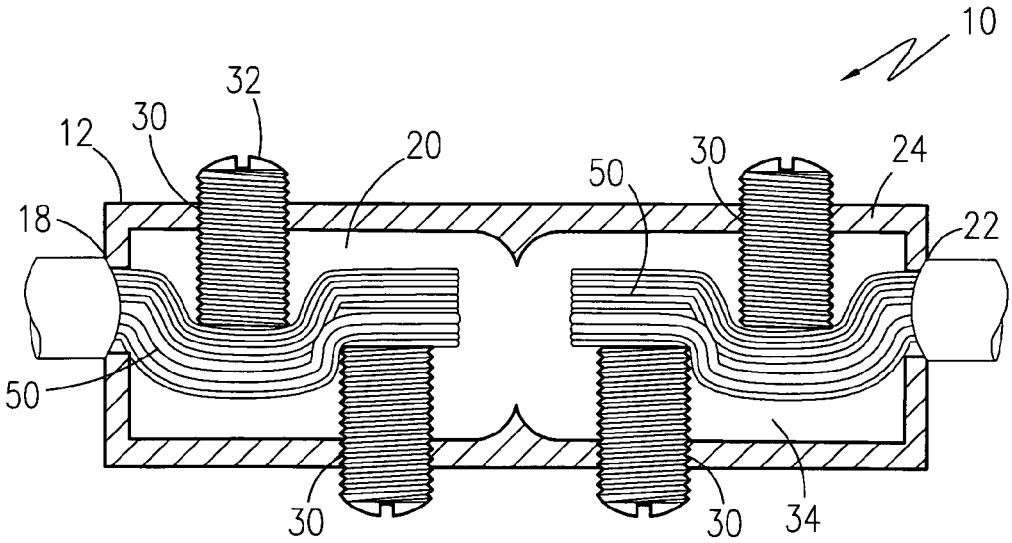
FIG. 2 is a cross sectional view thereof.

The best mode for carrying out the invention is presented in terms of its preferred embodiment, herein depicted within the FIGS. 1–2.

1. Detailed Description of the Figures

Referring now to FIGS. 1–2, an electrical tap connector 10 is shown, according to the present invention, having a housing 12 that forms a first attachment section 14 aligned with a second attachment section 16, each integrally formed with the housing 12. The first attachment section 14 forms a first conductor receiving orifice 18 into a first conductor receiving channel 20. The second attachment section 16 forms a second conductor receiving orifice 22 into a second conductor receiving channel 24.

The housing portion of the about each section 14, 16 forms a pair of opposed and offset screw receiving orifices

30 (two per conductor). Each pair of screw receiving orifices 30 are laterally offset from the centerline of any conductor 50 inserted into the conductor receiving orifice 18, 22. Each screw receiving orifice 30 is threadingly engaged with a set screw 32, which effectively "crimps" the conductor 50 in-situ when threadingly inserted. The each pair of opposed and offset set screws 32 thereby mechanically bind an electrical conduct 50 in a tortuous, crimped pattern within the receiving channel 20, 24. A conductive interior surface 34 thereby prevent any electrical disconnection even if the screws 32 become loosened over time due to conductor or atmospheric thermal cycling.

2. Operation of the Preferred Embodiment

It is anticipated that the teachings of the present invention can be used to accommodate various sizes of conductors depending upon the dimensions of the component parts. By selecting a conductor tap of an appropriate size in which the conductor receiving orifice 18, 22 corresponds to and accommodates the conductor size, by inserting the conductor 60, threadingly engaging the set screws 32 rigidly in an offset pattern, the conductors 50 are crimped in-situ and tapped together in a manner that prevents disengagement, even with the accidental or naturally gradual removal of one or more set screws.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

The invention claimed is:

1. An electrical tap connector comprising:

a housing forming a first attachment section aligned with a second attachment section;

said first attachment section forming a first conductor receiving orifice into a first conductor receiving channel;

said second attachment section forming a second conductor receiving orifice into a second conductor receiving channel;

a first pair of opposed and offset screw receiving orifices formed by said housing portion about said first attachment section;

a second pair of opposed and offset screw receiving orifices formed by said housing portion about said second attachment section; and a set screw threadingly engaged with each said screw receiving orifice; wherein each pair of screw receiving orifices are laterally offset from a centerline of any conductor inserted into either conductor receiving orifice such that when each screw receiving orifice is threadingly engaged with said set screw, any conductor inserted there in is effectively "crimped" in-situ.

2. The electrical tap connector of claim 1, wherein each pair of opposed and offset set screws thereby mechanically bind an electrical conduct in a tortuous, crimped pattern within said receiving channels, respectively.

3. The electrical tap connector of claim 1, wherein said conductor receiving orifice is sized to and accommodates with the conductor size.

4. The electrical tap connector of claim 3, wherein said conductor size is selected from the group comprising between size 14 and size 750 of the American Standard Wire Gauge size of conductors.

5. A method for tapping electrical conductors comprising:

a. providing a housing forming a first attachment section aligned with a second attachment section, said first attachment section forming a first conductor receiving orifice into a first conductor receiving channel and said second attachment section forming a second conductor receiving orifice into a second conductor receiving channel; wherein a a first pair of opposed and offset screw receiving orifices formed by said housing portion about said first attachment section and a second pair of opposed and offset screw receiving orifices formed by said housing portion about said second attachment section;

b. Inserting an electrical conductor into said first conductor receiving orifice; and c. threadingly engaging said set screws rigidly in an offset pattern such that said conductor is crimped in-situ and tapped together in a manner that prevents disengagement.

6. The method of claim 5, further comprising the steps a. Inserting an electrical conductor into said second conductor receiving orifice; and b. threadingly engaging said set screws rigidly in an offset pattern such that said conductor is crimped in-situ and tapped together in a manner that prevents disengagement.

* * * * *